United States Patent [19]

Oeschger

[11] Patent Number: 4,755,643

[45] Date of Patent: Jul. 5, 1988

[54] ELECTRONIC RELAY SWITCH WITH THERMAL/ELECTRICAL SHUNT

[75] Inventor: Joseph E. Oeschger, Palo Alto, Calif.

[73] Assignee: 501 F.L. Industries, Inc., Livingston, N.J.

[21] Appl. No.: 84,033

[22] Filed: Aug. 10, 1987

Related U.S. Application Data

[63] Continuation of Ser. No. 820,545, Jan. 17, 1986, abandoned.

[51] Int. Cl.[4] ..... H01H 1/66

[52] U.S. Cl. ..... 200/284; 335/151; 200/289

[58] Field of Search ..... 200/289, 305, 284, 239, 200/290, 146 R, 146 A, 146 AA, 144 R, 144 B, 237, 83 N; 335/151, 154; 361/380, 381, 386, 388, 389

[56] References Cited

U.S. PATENT DOCUMENTS

| | | | |
|---|---|---|---|
| 2,567,606 | 9/1951 | Kojis | 200/289 X |
| 2,854,550 | 9/1958 | Gerth et al. | 200/289 X |
| 3,344,253 | 9/1967 | Roessler et al. | 200/144 B |
| 3,534,192 | 10/1970 | Miles | 200/144 B |
| 3,576,066 | 4/1971 | Steward et al. | 335/154 X |
| 3,728,584 | 4/1973 | Kuhlow | 361/388 |
| 3,740,510 | 6/1973 | Grunert | 200/289 |
| 4,105,982 | 8/1978 | Oeschger | 335/151 |
| 4,110,585 | 8/1978 | Brown | 200/305 |
| 4,147,889 | 4/1979 | Andrews et al. | 361/388 |

FOREIGN PATENT DOCUMENTS

| | | | |
|---|---|---|---|
| 0145942 | 11/1979 | Japan | 200/305 |

*Primary Examiner*—Henry J. Recla
*Assistant Examiner*—Ernest G. Cusick
*Attorney, Agent, or Firm*—Elliot M. Olstein; John G. Gilfillan; Jeremiah G. Murray

[57] ABSTRACT

The existent current and thermal path of a diaphragm and a movable rod contained within an electronic switch are paralleled with a shunt which does not have to support external loads, and can thus be made of material more ideally suited for the transfer and dissemination of heat generated by the passage of current upon actuation of the switching device.

4 Claims, 1 Drawing Sheet

ELECTRONIC RELAY SWITCH WITH THERMAL/ELECTRICAL SHUNT

This is a continuation of application Ser. No. 820,545, filed Jan. 17, 1986 and now abandoned.

BACKGROUND

1. Field of the Invention

The present invention relates to electronic relay switches. More particularly, the present invention relates to a means for both decreasing the amount of heat generated by such switches and improving the ability of electronic relay switches to transfer heat away from the switching element.

2. Brief Description of the Prior Art

Presently available electronic relay switching devices include those composed of two refractory metal rods encased in an evacuated capsule. The two rods are commonly at right angles to each other, and each is electrically connected to one or more contact tabs which extend from the capsule. One of the rods is fixed, the other is movable through or pivots about a thin diaphragm located at one end of the capsule through which the pivotal, or movable, rod extends. In certain embodiments, a ceramic tube is attached to an extension of the movable rod which protrudes through the diaphragm. Electromagnetic or mechanical means are normally employed to pivot the ceramic tube and the movable rod in the appropriate direction towards and at right angles to the fixed rod until they touch, thus activating the relay switch. Angular motion is transmitted to the movable rod through the diaphragm so that the distance between the two crossed rods (fixed and movable) can be changed from zero when touching to a predetermined distance which is selected to accommodate the dielectric withstand voltage. Thus the distance that the movable rod must pivot is a small amount, commonly varying from 0.001 to 0.020 inches.

In the closed or activated position of the switch described, current flows through a contact tab extending out from the body of the switch, which tab may be adjacent the diaphragm. Current then flows through the diaphragm, and into and along the movable rod until it meets the contact point on the fixed rod. The current then enters the fixed rod, and travels into its support structure and out of the switch through a second contact tab which is electrically connected to the fixed rod. In the open position, the rods are separated by the small gap described above, which due to the very high dielectric strength of the vacuum is capable of operating at voltage differentials in the range of up to 1000 to 2000 volts per 0.001 inch.

Typically, the position of the switch is controlled by an actuator contacting the ceramic tube attached to the movable rod. The actuator is attached to a circular flange located at the diaphragm end of the switch capsule. One example of an actuator and switch of the type described above can be seen in applicant's issued U.S. Pat. No. 4,105,982, the disclosure of which is incorporated by reference, and which is hereinafter referred to as "my earlier Patent."

To transfer motion through the flexible diaphragm without requiring an excessive force to activate the relay switch, and to obtain a usable mechanical life of the diaphragm element for the motion necessary to obtain the decided upon open switch gap, it is necessary to use a very thin diaphragm element, sometimes on the order of 0.001 inches thick. This necessary thinness of the diaphragm element limits its ability to transfer heat away from the movable contact rod to the body and contact tabs of the switch.

It is also necessary to use a movable rod having as small a diameter as possible to obtain an acceptable operating and mechanical life of the diaphragm. This limits the ability of the rod to carry heat away from both the contact point of the two refactory rods and its internally generated losses to the diaphragm.

In order to build a switch with acceptable yields and still meet various operational requirements, it has been found that molybdenum is the preferred material for the diaphragm. However, molybdenum's electrical resistivity is considerably greater than that of copper. This results in generating a greater heat loss for a given current than copper. Also, the thermal conductivity of molybdenum is low compared to that of copper, thus realizing lesser heat transfer through the diaphragm than would be realized with a material such as copper.

The effect of the inadequate capability to dissipate heat, of the switches described above, is made even worse so when RF current travels through the switch because of "skin effect". As RF frequency increases, the effective depth of penetration of the current, from the surface of the conductor to the interior of the conductor, is decreased. In effect, the current is crowded towards the surface of the conductor. This in turn causes an increase in effective resistance which increases the heat generated by the current carrying elements.

In the case of the switch in question, the increase in RF current heating due to "skin effect" coupled with the limited thermal conductivity of the diaphragm and movable rod results in a sharp decrease in RF current carrying ability as frequency increases.

SUMMARY OF THE INVENTION

It is an object of the present invention to improve the heat transfer characteristics contained within an electronic relay switch.

It is a further object of the present invention to reduce the heat generation within an electronic relay switch.

An additional object of the present invention is to provide a switch having a diaphragm and movable contact construction with shunts to provide parallel paths for the passage of electrical current and thermal energy in the switch.

Yet another object of the present invention is to provide a switch having a diaphragm and moveable contact construction with current and heat shunts which do not have to support external loads, and thus can be made of highly heat and electrically conductive materials of low strength, such as copper.

DESCRIPTION OF THE PREFERRED EMBODIMENT

Figure 1:
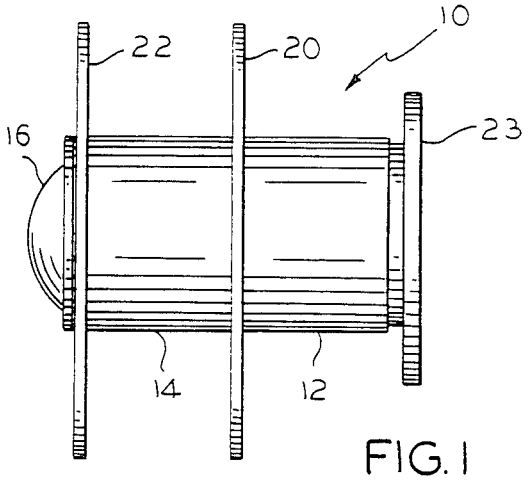
FIG. 1 in a overall view of the sealed relay switching assembly.

Referring to FIG. 1, a relay switch assembly identified generally as 10 has two hollow cylindrical ceramic shell housing members 12, 14 which form the insulating and support portions of the sealed and evacuated enclosure or capsule. Sealing of housing member 14 is effectuated by the metallic cap 16 on one end, and by the flexible conductive diaphragm 18 (FIGS. 3, 4) at the other end.

In actual use, the usual orientation of the relay switch assembly 10 is: longitudinal axis is vertical, with cap 16 topmost. Hence the left-to-right progression in the sense of FIG. 1 (or FIG. 3 or 4) corresponds usually to a top-to-bottom progression of the relay assembly in use.

The relay switch assembly 10 shown in FIGS. 1 to 4, considered for the time being apart from the features of the present invention, is a simplified version of the relay switch assembly shown in the composite of FIGS. 1 and 6 of my earlier patent. The simplification has two aspects:

(1) Simplification of the structure itself. Progressing left-to-right ("top of relay structure to bottom") in FIG. 1, of my earlier patent, three distinct chambers are encountered; these are defined by hollow ceramic wall members 11, 12, 13. Considering FIG. 3 hereof, merely the two members 14 and 12 are shown. Since the so-called switching rod (herein 24; in the earlier patent 27) ends in the "bottom-most" chamber, it is evident that no "middle chamber" (in the sense of FIG. 1 of my earlier patent) appears in FIGS. 1, 3, 4 hereof; the middle chamber has been omitted, because it is unnecessary. This stems from the fact that in my earlier patent, the relay switch is illustrated by way of example, as constructed for single-pole-double-throw switching action; note the alternate contacts 16 and 19 thereat. Here, the relay switch is illustrated, by way of example, as constructed for merely single-pole-single-throw switching action; note the single contract 39 herein.

(2) Simplification in illustration (and corresponding description), in the interest of brevity. In FIG. 1 of my earlier patent, the switching rod 27 at its right-end portion ("bottom-end portion") is shown with an overfitting ceramic tube 26 which extends to the right end of the end-chamber. Herein such ceramic tube has not been shown, but should be deemed to be present in the relay switch assembly hereof, notably FIG. 3 or 4, as a necessary part of the switching rod 24. Furthermore, and referring to FIG. 6 of my earlier patent, that FIG. 6 shows an actuator and linkage assembly, which at its left end ("top end") terminates in a leftwardly projecting member 65*a* which penetrates into the right-end chamber of FIG. 1 thereof, and there imparts actuating motion to the ceramic tube 26, and hence the switching rod 27. That switching assembly with its end member 65*a* have not been illustrated herein, but should be deemed to be included herein, to similarly impart actuating motion.

Figure 3:
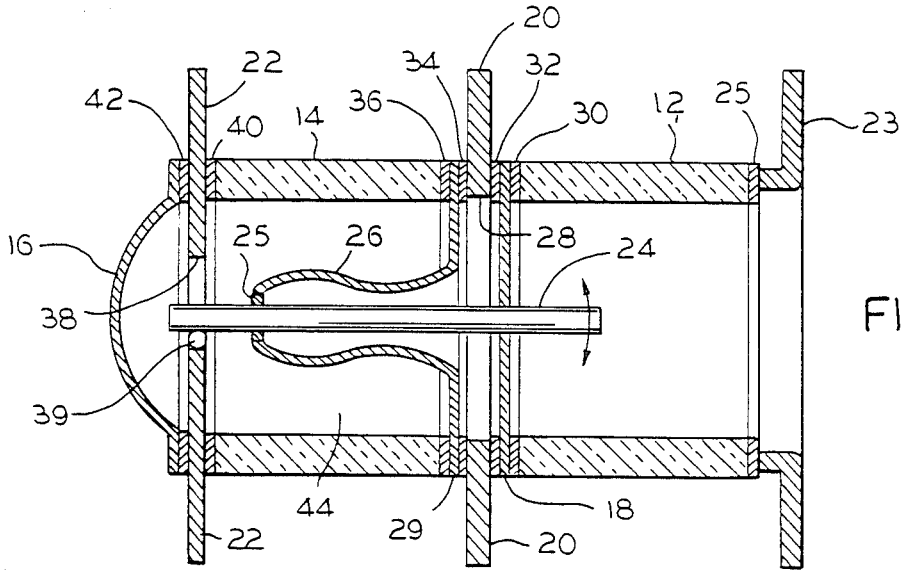
FIG. 3 is a partially exploded cross sectional view taken generally along the line 3—3 of FIG. 2 with the cap and Fixed Contact Assembly in place.
Figure 4:
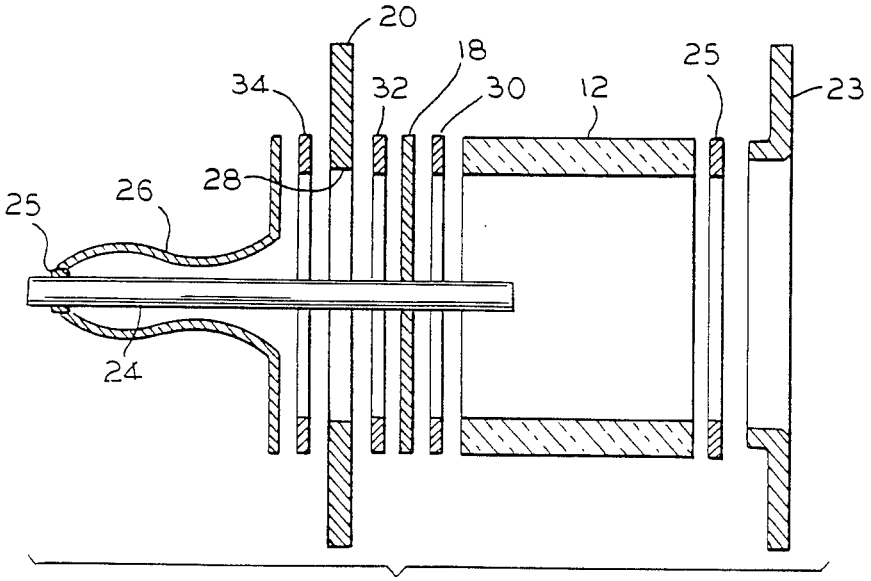
FIG. 4 is an exploded cross sectional view of a partially assembled device taken generally along the line 3—3 of FIG. 2.
Figure 5:
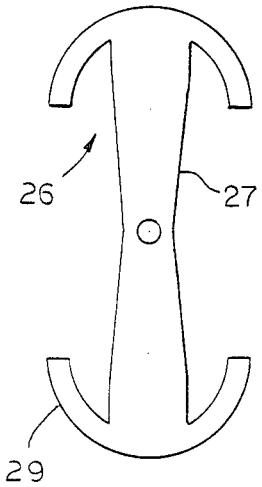
FIG. 5 is a plan view of the shunt element of the present invention prior to assembly.

The features of this invention, that is the aspects which depart materially from the teachings of my earlier patent, reside in the provision of the thermal/electrical shunt element 26, as this is shown in FIG. 5 before its incorporation into the switching relay 10, and FIGS. 3 and 4, after such incorporation. The opposite end of housing member 12, that is its right end or bottom end, includes a flange part 23 brazed to ceramic housing member 12. Flange part 23 has a central bore therethrough, and provides a convenient means for connecting the switch actuator (shown in FIG. 6 of my earlier patent) to the finished switch assembly 10. A washer-like annular disc 25 of brazing material (FIG. 4) is inserted between flange part 23 and ceramic housing 12 to effect attachment of the flange part to the ceramic housing. First fixed external contact tab or terminal 20, and second fixed external contact tab or terminal 22 provide external electrical access to the conductive components inside of switch 10.

A portion of the type of switch embodying the present invention is seen in FIG. 4. Switching rod 24 is sealingly connected to ceramic housing 12 by the flexible conductive diaphragm 18, which is conductively connected to the first fixed exterior tab or terminal 20. Thus, a current path from the first fixed exterior terminal 20 to the end of the switching rod 24 is defined through diaphragm 18. Diaphragm 18 is connected to contact plate 28 of the first fixed exterior terminal 20 by two washer-type discs of brazing material 30 and 32. These discs are also conductive, thus defining a current path. This current path is paralleled by shunt element 26, which is connected to the switching rod 24 at a point on rod 24 just below where the rod contacts fixed contact rod 39 (FIG. 3) by brazing material 25, thereby providing alternative current paths from the first fixed exterior terminal 20, through contact plate 28 and conductive brazing disc 34, and continuing through shunt 26 to the end of the switching rod 24.

Figure 2:
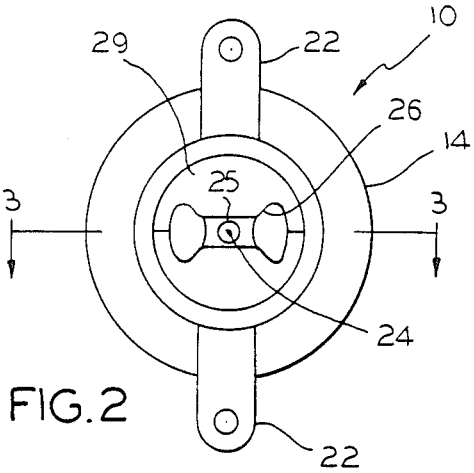
FIG. 2 is a plan view looking down at the top of the device shown in FIG. 1 with the cap and Fixed Contact Assembly removed.

In FIG. 2, the conductive switching rod 24 can be seen surrounded by the shunt element 26, which is preferably made of a highly conductive and elastic material such as copper. Although it has been found that copper is the best material for shunt 26, other materials may be suitable. It has been found that due to copper's very high thermal conductivity and very low resistivity, it is ideal for this purpose. Additionally, the low elastic modulus of copper results in a minimum increase in torque forces necessary to operate the switch, as well as a minimum change in stress in the shunt. The lower the stress change during operation, the higher the fatigue life of the part.

FIG. 3 shows the complete relay switch structure in an assembled condition. The assembly described thus far may be joined together either by hydrogen furnace brazing with subsequent defusion exhaustion of the hydrogen, or in a vacuum furnace, the latter being preferred. The procedure for accomplishing this brazing operation is set forth in greater detail in my U.S. Pat. No. 4,105,982. The ceramic housing element 14 is sealingly connected to the assembly seen in FIG. 4 by a fourth washer-type disc 36 of brazing material. The fixed contact plate 38 of the second fixed exterior terminal 22 including the fixed contact rod 39 is connected to the ceramic housing element 14 by a fifth washer-type discs 40 of brazing material. The metallic cap 16 is then connected by a sixth washer-type disc 42 of brazing material in the aforementioned brazing process, thus sealing the vaccum chamber 44 of the switch 10.

FIG. 5 shows a plan view of the shunt element 26 prior to assembly. The shunt element 26 has the shape of a double-anchor, the two similar anchors extending symmetrically from a central aperture, through which the switching rod 24 will penetrate. Preferrably, shunt 26 is made into a relatively thin sheet of thermally and electrically conductive metallic material, preferably copper, of the order of several thousandths of one inch, for example approximately 0.003 inches in thickness. The shunt has a tapered cross section as at 27; the sense of the taper is increase in transverse width with increase in radial distance, away from the central aperture. This provides more uniform stress distribution throughout the shunt when it is flexed back and forth as movable rod 24 moves back and forth as described above. Curved or arcurate end elements 29 are formed at the ends of shunt 26 to correspond with the circumference of ceramic housing member 14. Thus, when shunt 26 is formed into its final assembly configuration as shown in FIGS. 2, 3, and 4, the elements 29 meet and form a circular base to provide a proper means to enable brazing of shunt 26 to contact plate 28 and ultimately to ceramic housing 14. The shunt 26 is also brazed at its left end (in the sense of FIG. 3 or 4), at and about its central aperture (FIG. 5), to the switching rod 24, by means of brazing material 25, as has been indicated above. Thus the taper sections 27 (FIG. 5), and indeed each half-part of the shunt, become cantilevered to the switching rod at 25; in extending righwardly from the cantilever attachment at 25, the tapered sections are curved so as to define approximately sinusoidal shapes-which are symmetrical to each other as is seen in FIGS. 3 and 4. The shunt 26 in place, conforms to the essentially circular and coaxial, uniaxial orientation of the switching relay assembly 10. The shunt 26 is also curved in the thin direction when assembled so that the diaphragm 18 is free to move up and down in a direction parallel to the axis of the movable contact rod without increasing the cyclic stress in either the diaphragm or the shunt.

Thus, it is seen that the addition of shunt 26 provides three paths for the current to pass in going from contact tabs 20 to the point of contact between movable rod 24 and fixed rod 39 (FIG. 3). Upon actuation of the switching device 10, a current path is defined from the first fixed exterior terminal or tab 20, through the contact plate 28 and washer-type disc 32 to flexible diaphragm 18, then through switching rod 24, and fixed contact rod 39, and then through the fixed contact plate 38, to the second fixed exterior terminal or tab 22.

Alternately, the current path is defined from the first fixed exterior terminal or tab 20, through the contact plate 28 and washer-type disc 34 to the shunt element 26. At this juncture, the current flows along either side of shunt 26 to the brazing point 25 where shunt 26 is connected to rod 24. Thus, the shunt provides two parallel paths for the current to flow to the rod 24. The current then flows along the upper portion or tip of switching rod 24, through the fixed contact rod 39, through the fixed contact plate 38, and then to the second fixed exterior terminal or tab 22.

The same paths defined above also function to transfer heat away from the contact point of rods 24 and 32 and to the outside of the switch element 10 through contact tabs 20,22. Thus, shunt 26 provides the further function of providing two additional paths for carrying heat away from rods 24 and 39 to the outside of the switch. Obviously, this decreases the buildup of internal heat energy, which increases the efficiency of the switching device 10.

It should be understood that various modifications can be made to the preferred embodiments disclosed herein without departing from the spirit and scope of the invention or without the loss of its attendant advantages. Thus, other examples applying the principles described herein are intended to fall within the scope of the invention provided the features stated in any of the following claims or the equivalent of such be employed.

I claim:

1. An electronic switching relay having a switching rod and a thermal/electrical shunt, the shunt including a shunt member made into a relatively thin sheet of thermally and electrically conductive material, the shunt member having a central point and being shaped to form symmetrical double anchors with symmetry about, and extending symmetrically from, said central point, at which is provided a through-aperture for penetration therethrough by said switching rod, when the shunt member is incorporated in the relay, each anchor being tapered such that it experiences an increase in transverse width with increase in radial distance, away from the central aperture, the tapered portions terminating, remote from the central aperture, in respective arcuate portions which are symmetrical to each other, and each arcuate portion symmetrical with respect to its tapered portion, the arcuate portions being mounted in a common plane and having arcuate lengths and curvatures such that the arcuate portions abut and define a closed planar figure which is essentially a circle.

2. An electronic switching relay as claimed in claim 1 wherein the sheet of thermally and electrically conductive material has a thickness of the order of several thousandths of one inch.

3. An electronic switching relay as claimed in claim 2 wherein the thermally and electrically conductive material is copper.

4. An electronic switching relay as claimed in claim 3 wherein the thermally and electrically conductive material is copper.

* * * * *